United States Patent [19]

Takahashi

[11] Patent Number: 4,718,832

[45] Date of Patent: Jan. 12, 1988

[54] ELECTROMAGNETIC RECIPROCATING PUMP

[75] Inventor: Shiro Takahashi, Tokyo, Japan

[73] Assignee: Man Design Co., Ltd., Japan

[21] Appl. No.: 828,445

[22] Filed: Feb. 10, 1986

[30] Foreign Application Priority Data

Mar. 11, 1985 [JP] Japan ..... 60-46494

[51] Int. Cl.[4] ..... F04B 17/04; F04B 35/04

[52] U.S. Cl. ..... 417/417; 417/62; 417/257; 417/419

[58] Field of Search ..... 417/417, 416, 418, 419, 417/338, 62, 238, 257, 256, 263, 265, 267, 259, 262; 415/DIG. 3

[56] References Cited

U.S. PATENT DOCUMENTS

| | | | |
|---|---|---|---|
| 2,858,767 | 11/1958 | Smith | 417/529 |
| 3,228,587 | 1/1966 | Segebrecht | 417/62 |
| 4,127,360 | 11/1978 | Carpenter | 417/539 |
| 4,350,475 | 9/1982 | Meece et al. | 417/238 |
| 4,556,367 | 12/1985 | Schmid | 417/18 |

FOREIGN PATENT DOCUMENTS

| | | | |
|---|---|---|---|
| 125371 | 9/1980 | Japan | 417/417 |
| 30984 | 2/1982 | Japan . | |
| 773827 | 5/1957 | United Kingdom | 417/62 |
| 591610 | 2/1978 | U.S.S.R. | 417/417 |

*Primary Examiner*—Carlton R. Croyle
*Assistant Examiner*—Donald E. Stout
*Attorney, Agent, or Firm*—Kinney & Lange

[57] ABSTRACT

Electromagnetic reciprocating pump including a plurality of pumps combined in such a manner that the mode of connection between the suction inlet and the discharge outlet in each of the pumps is allowed to be changed and, as the result, the amount of suction or discharge or the degree of vacuum or compression is allowed to be selected at a multiplicity of stages without any loss of the energy of the alternating current power. The plurality of pumps are disposed in such a manner that the axes of their respective pistons intersect one another at one point and the pumps themselves are rotationally symmetrical with respect to the point mentioned above.

1 Claim, 17 Drawing Figures

ELECTROMAGNETIC RECIPROCATING PUMP

BACKGROUND OF THE INVENTION

1. Field of the Invention

This invention relates to an electromagnetic reciprocating pump, and more particularly relates to an electromagnetic reciprocating pump which permits the amount of suction or discharge or the degree of vacuum or compression to be selected at multiple stages.

2. Description of the Prior Art

A fluidal machine such as the electromagnetic reciprocating pump or compressor is provided, as disclosed in the specification of Japanese Patent Publication SHO No. 57(1982)-30,984 or Japanese Utility Model Appln. SHO No. 59(1984)-141,664, for example, with a cylinder and a piston which jointly engage in transfer of a fluid and a magnetic armature which is integrally formed with the piston.

Around the magnetic armature is disposed a stationary electromagnet adapted to drive it. The stationary electromagnet, on application thereto of a half-wave alternating current or a pulse current, attracts the magnetic armature in the direction of axis and, on release of the applied current, allows the magnetic armature to be returned by the repulsive action of a return spring. Thus, the piston which is formed integrally with the magnetic armature is reciprocated to permit transfer of a fluid.

The number of reciprocation of the piston, therefore, equals the frequency of the half-wave alternating current applied to the stationary electromagnet. For the electromagnetic reciprocating pump to be driven with high efficiency, it is necessary that the frequency of the alternating current mentioned above should substantially agree with the natural frequency of the reciprocating system composed of the piston, the magnetic armature, and the return spring.

The prior art described above, has posed the following problem.

There is felt the need of enabling the electromagnetic reciprocating pump to vary the amount of suction or discharge or the degree of vacuum or compression. To realize this need, it is necessary that the frequency of the half-wave alternating current applied to the stationary electromagnet should be varied.

When the frequency of the half-wave alternating current applied to the stationary electromagnet does not agree with the natural frequency of the reciprocating system composed of the piston, the magnetic armature, and the return spring, the loss of energy is increased the electromagnetic reciprocating pump cannot be efficiently driven.

SUMMARY OF THE INVENTION

This invention is characterized by having a plurality of pumps combined in such a manner that the mode of connection between the suction inlet and the discharge outlet in each of the pumps will be allowed to be changed and, as the result, the amount of suction or discharge or the degree of vacuum or compression will be allowed to be selected at a multiplicity of stages without any loss of the energy of the alternating current power source.

This invention is further characterized in that the plurality of pumps are disposed in such a manner that the axes of their respective pistons will intersect one another at one point and the pumps themselves will be rotationally symmetrical with respect to the point mentioned above and, as the result, there will be derived the operation and effect of counter-balancing the vibrations and abating the noises generated by the individual pumps.

DETAILED DESCRIPTION OF THE PREFERRED EMBODIMENTS

Now, the present invention will be described in detail below with reference to the accompanying drawings.

Figure 1:
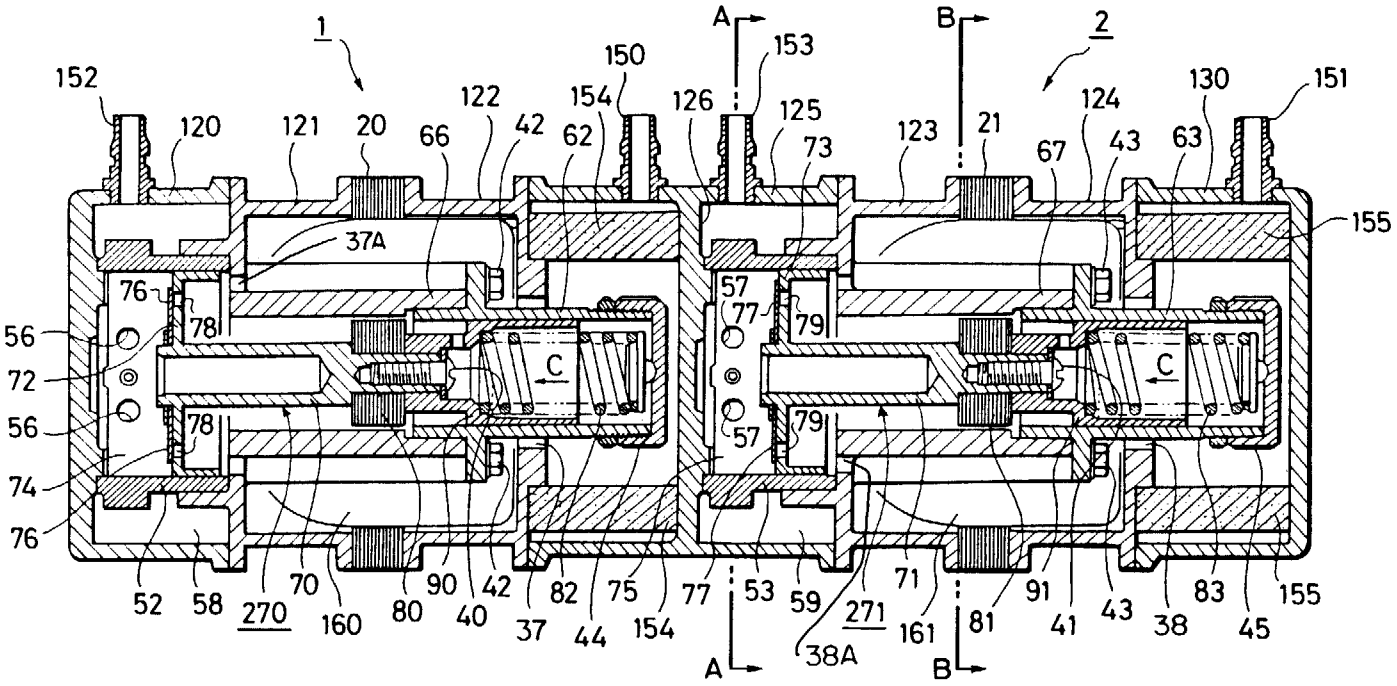
FIG. 1 is a schematic longitudinal cross section of this invention.

As illustrated in FIG. 1, a first front cylinder 52 is fastened to a front lid 120 so that the internal surface of the front cylinder 52 and the front lid 120 will define a first compression chamber 74. Similarly, a second front cylinder 53 is fastened to a partition panel 126 of a central barrel 125 so that the internal surface of the second front cylinder 53 and the partition panel 126 will define a second compression chamber 75.

Figure 2:
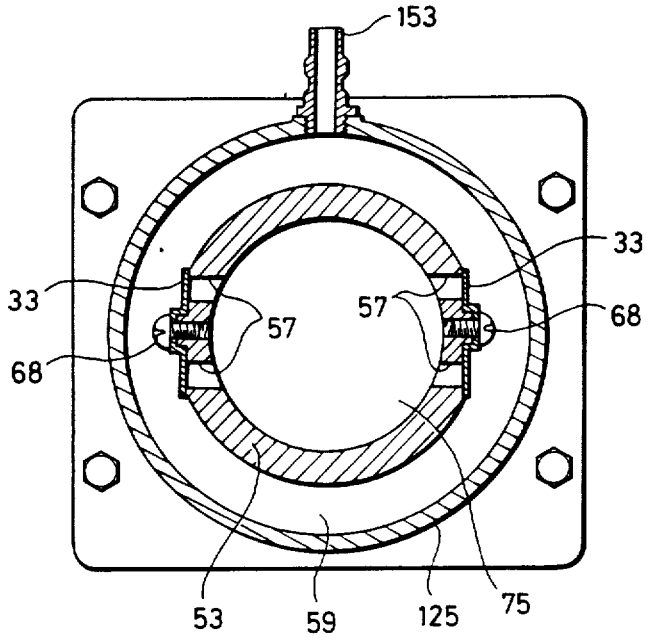
FIG. 2 is a schematic cross section taken through FIG. 1 along the line A—A.

In the first and second front cylinders 52, 53, there are respectively formed first and second discharge holes 56, 57. To the second front cylinder 53, discharge valves 33 are attached with fitting screws 68 as illustrated in FIG. 2 so as to block the second discharge holes 57 when the pressure of the second compression chamber 75 is lower than the pressure of the second discharge chamber 59. Similarly to the first front cylinder 52, discharge valves are attached so as to block the first discharge holes 56 when the pressure of the first compression chamber 74 is lower than the pressure of the first dischage chamber 58.

A front barrel 121 and a rear barrel 123 are tubular in shape and are provided therein respectively with first and second rear cylinder supporting members 66, 67. One ends in one direction of the first and second rear cylinder supporting members 66, 67 are fastened to the front lid 120 and the first front cylinder 52 and to the central barrel 125 and the second front cylinder 53. To the other ends of the first and second rear cylinder supporting members 66, 67, first and second rear cylinders 62, 63 are attached fast with fitting bolts 42, 43.

A first piston 270 and a second piston 271 are composed respectively of first and second front pistons 70, 71, first and second magnetic armatures 80, 81, and first and second rear pistons 90, 91. The first and second front pistons 70, 71, the first and second magnetic armatures 80, 81, and the first and second rear pistons 90, 91 are fastened with fitting screws 40, 41 so that their respective axes will coincide.

For the first and second pistons 270, 271 to be slidable in their axial directions, first and second piston heads 72, 73 of the first and second pistons 70, 71 and the first and second rear pistons 90, 91 are respectively inserted in the first and second front cylinders 52, 53 and the first and second rear cylinders 62, 63.

In the first and second piston heads 72, 73, there are respectively formed a first and a second suction hole 78,79. To the first and second piston heads 72, 73, check valves 76, 77 are attached to the first and second piston heads 72, 73, so as to block the first and second suction holes 78, 79 when the pressure on the sides of the first and second suction holes open to first and second suction inlets or intake orifices 150, 151 respectively, is lower than the pressure at the first and second discharge holes 56, 57 side.

A first and a second return spring 82, 83 are disposed as illustrated in the diagram between a first and a second cap 44, 45 respectively screwed to the first and second rear cylinders 62, 63 and the first and second rear pistons 90, 91. The first and second return springs 82, 83, bias or urge the first and second front pistons 70,71, the first and second magnetic armatures 80, 81, and the first and second rear pistons 90, 91 respectively in the direction of the arrows C indicated in FIG. 1.

Figure 3:
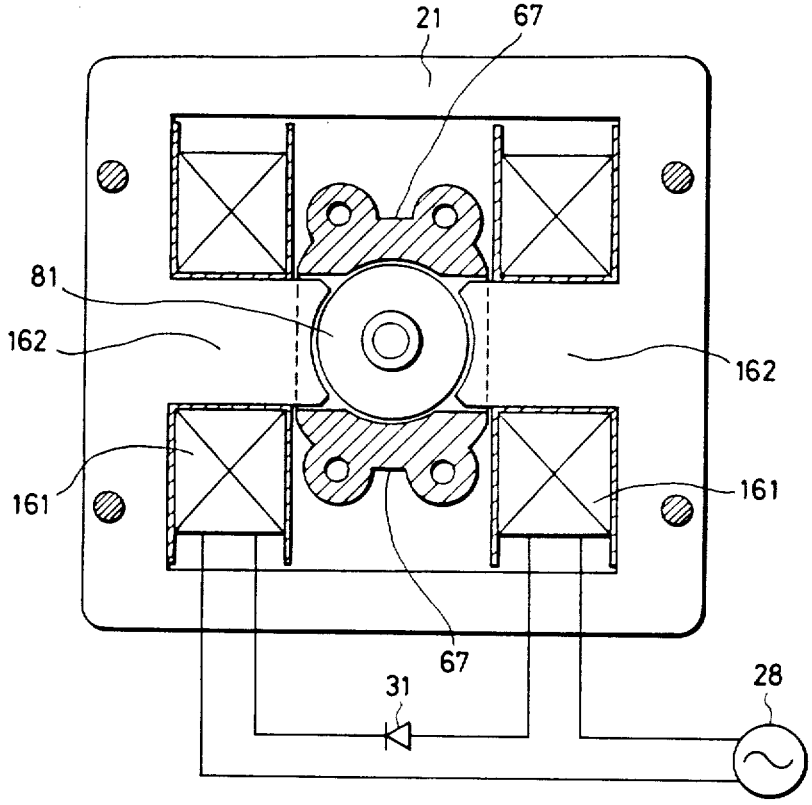
FIG. 3 is a schematic cross section taken through FIG. 1 along the line B—B.
Figure 8:
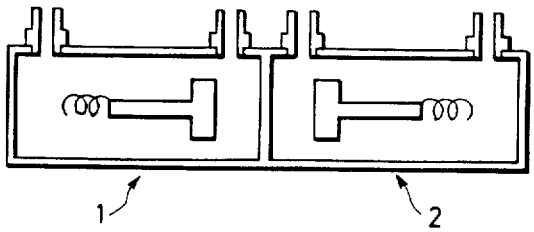
FIG. 8 through FIG. 10 are schematic diagrams illustrating typical modifications of the present invention.

A second stationary electromagnet 21 is provided, as illustrated in FIG. 3, with a pair of magnetic poles 162. A separate excitation coil 161 is wound around each of the magnetic poles 162. Similarly to the second stationary electromagnet 21, a first stationary electromagnet 20 is provided with electric poles and excitation coils 160.

The first and second stationary electromagnets 20, 21 are disposed as interposed respectively between the pair of front barrels 121 and 122 and between the pair of rear barrels 123 and 124. To the front barrel 122 and the rear barrel 124, the central barrel 125 and the rear lid 130 are respectively attached fast. The first section inlet 150 is formed on the outer wall of the central barrel 125 anterior to the partition panel 126 (on the left-hand side in FIG. 1).

A first discharge outlet or delivery orifice 152 is formed on the outer wall of the front lid 120. The flow passage is thus formed from the first section inlet 150, through passageways 37, into the interior of front barrel 121, and through the clearance between the first cylinder supporting member 66 and the wall of barrel 121 which provides openings 37A and then through suction holes 78, and through first discharge holes 56 to the first discharge chamber 58 and to the first discharge outlet or delivery orifice 152.

The second suction inlet 151 is formed on the outer wall of the rear lid 130, and second discharge outlet or delivery orifice 153 is formed on the outer wall of the central barrel 125 in the rear part thereof (on the right hand side in FIG. 1). The flow path in this portion of the device in FIG. 1 is from the suction inlet 151, through the apparature 38, and into the space between the rear barrels 123 and 124 through apparatures 38A formed between the second cylinder supporting member 67, then through second suction holes 79, and through the second discharge holes 57, to the second discharge chamber 59, and to the second discharge outlet or delivery orifice 153.

A filter 154 is disposed inside the front half part of the central barrel 125 and a filter 155 is disposed inside the rear lid 130. The filters 154, 155 are intended to remove dust and dirt from the gas introduced through the first and second suction inlets 150, 151.

It is clear from the foregoing description that, in the configuration of FIG. 1, the first and second pumps 1, 2 are formed respectively on the left-hand and right-hand sides of the partition panel 126.

Figure 4:
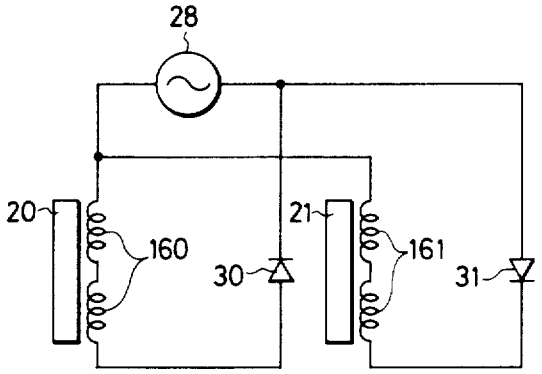
FIG. 4 is an electric wiring diagram in one embodiment of this invention.

FIG. 4 represents an electric wiring diagram in one embodiment of this invention.

An excitation coil 160 for a stationary electromagnetic 20 (FIG. 1) and an excitation coil 161 for a stationary electromagnet 21 (FIG. 1) are connected in parallel to an alternating current power source 28. Coils 160, 161 are serially connected to a separate rectifier 30, 31 in reversed polarity. The half waves of the alternating current emitted from the to the excitation coils 160, 161 power source 28 are fed alternately.

Now, the operation of one embodiment of this invention of the foregoing construction will be described below.

Figure 5A:
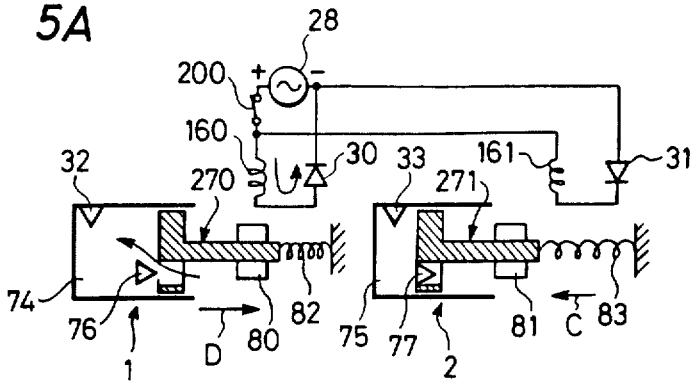
FIGS. 5A to 5C are schematic structural diagrams for illustrating the operation of one embodiment of this invention.
Figure 5B:
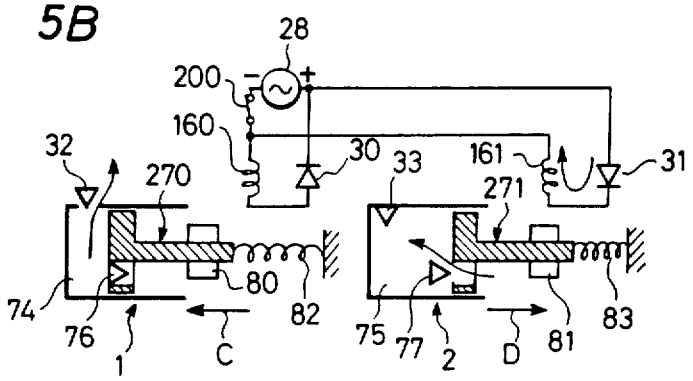
Figure 5C:
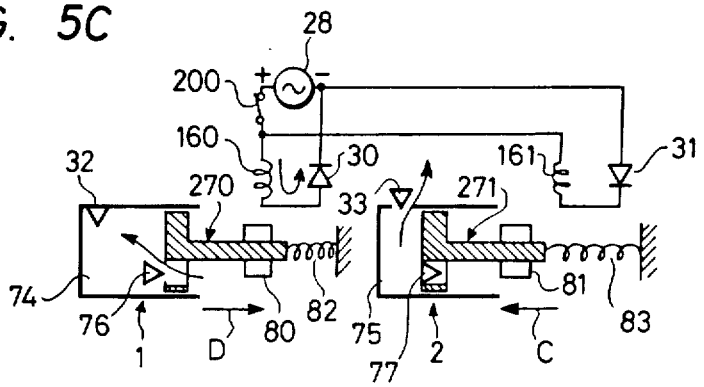

FIGS. 5A to 5C are structural diagrams schematically representing FIG. 1 for facilitating the description of the operation of one embodiment of this invention.

While a power source switch 200 is not closed, the first piston 270 of the first pump 1 and the second piston 271 of the second pump 2 are deviated respectively by a first and a second return spring 82, 83 in the direction of the arrow C (FIGS. 5A to 5C). The suction valves 76, 77 and the discharge valves 32, 33 are closed.

When the power source switch 200 is closed, the exciting coil 160 is energized by one half wave of the alternating current flowing through the rectifier 30 to attract the first piston 270 of the first pump 1 in the direction of the arrow D as illustrated in FIG. 5A. At this time, the suction valve 76 of the first piston 270 is opened to admit the ambient air through the first suction inlet 150 (FIG. 1) into the first compression chamber 74. In the meantime, since the rectifier 31 is reversely biased, no electric current flows to the coil 161 and no action is imparted to the second piston 271.

When the subsequent half wave of the alternating current energizes the coil 161, the second piston 271 of the second pump 2 is attracted in the direction of the arrow D as illustrated in FIG. 5B. At this time, the suction valve 77 of the second piston 271 is opened to admit the ambient air through the second suction inlet 151 into the compression chamber 75. As the flow of electric current to the coil 161 is started, the flow of electric current to the coil 160 is ceased. As the result, the first piston 270 of the first pump 1 is returned by the force of the second return spring 82. At this time, the discharge valve 32 is opened to release the fluid from the interior of the first compression chamber 74 into the first discharge chamber 58 (FIG. 1).

Thereafter, as illustrated in FIG. 5C, the next half wave of the alternating current again energizes the coil 160 to attract the first piston 270 in the direction of the arrow D and, at the same time, open the suction valve 76 and admit the ambient air into the first compression chamber 74. When the flow of electric current to the coil 160 is started, the flow of electric current to the coil 161 is ceased. As the result, the second piston 271 of the second pump 2 is returned in the direction of the arrow C by the biasing force of the second return spring 83. At this time, the discharge valve 33 is opened to release the fluid from the interior of the second compression chamber 75 into the second discharge chamber 59.

In this manner, the excitation coils 160, 161 are alternately energized by the successive half waves of the alternating current and the first and second stationary electromagnets 20, 21 are alternately excited. As the result, when the piston of one of the pumps is attracted by the excitation of the stationary electromagnet, the piston of the other pump is returned by the repulsive force of the return spring in the direction opposite the direction of the attraction mentioned above.

The pistons in the first and second pumps, therefore, are reciprocated in mutually opposite directions. Since the vibrations of these pistons are mutually offset, the pump of the present embodiment as a whole suffers from only nominal vibration and emits low noise.

Further, since the two half waves of the alternating current are used in exciting the stationary electromagnets, the electromagnetic reciprocating pump can be driven with notably high efficiency.

Figure 6A:
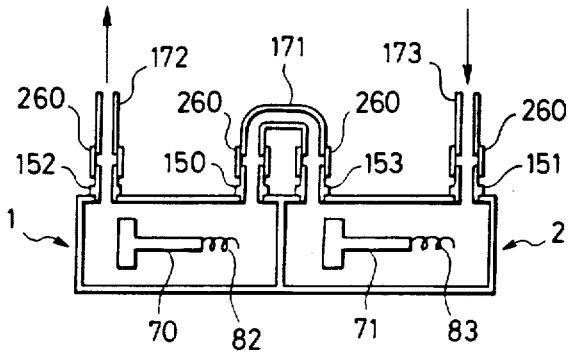
FIGS. 6A to 6C are schematic diagrams illustrating a typical connection between suction inlets and discharge outlets in one embodiment of this invention.
Figure 6B:
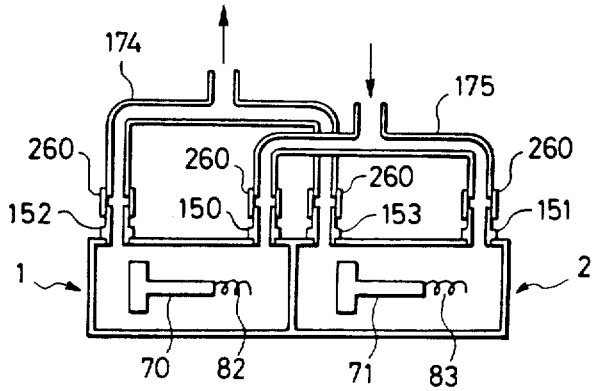
Figure 6C:
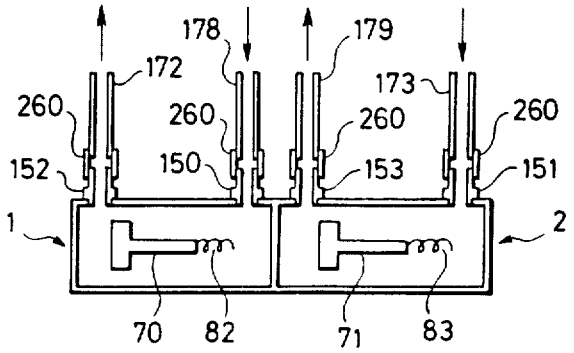

FIGS. 6A to 6C are schematic diagrams illustrating a typical connection between the first and second suction inlets 150, 151 and the first and second discharge outlets 152, 153 in the pump illustrated in FIG. 1. In FIGS. 6A to 6C, the parts identical or similar to those found in FIG. 1 are denoted with the same reference numbers.

First with reference to FIG. 6(A), the passages for fluid in the first pump 1 and the second pump 2 are connected in series. To be specific, the discharge outlet 153 of the second pump 2 is connected via a connection tube 171 to the suction inlet 150 of the first pump 1. On the opposite ends of the connection tube 171 are attached fast sockets 260 which are constructed as described afterward with reference to FIG. 7A. The sockets 260 are connected to the first suction inlet 150 and the second discharge outlet 153. The second suction inlet 151 is connected via a similar socket 260 to a suction tube 173 and the first discharge outlet 152 is connected via another similar socket 260 to a discharge tube 172.

When the passages for fluid in the first pump 1 and the second pump 2 are serially connected as described above, the gas (fluid) which is introduced through the suction tube 173 is discharged through the discharge tube 172 and the degree of vacuum (or the degree of compression) is roughly two times as high as when the first pump 1 or the second pump 2 is used independently.

In the construction of FIG. 6B, the paths for fluid in the first pump 1 and the second pump 2 are parallelly connected. More specifically, the first and second suction inlets 150, 151 of the first pump 1 and the second pump 2 are connected through the respective sockets 260 to a common forked connection tube 175 and the first and second discharge outlets 152, 153 of the first pump 1 and the second pump 2 are connected through the respective sockets 260 to a common forked connection tube 174.

In this embodiment, the gas introduced through the forked connection tube 175 is discharged through the forked connection tube 174 and the amount of suction (or the amount of discharge) is roughly two times as large as when the first pump 1 or the second pump 2 is used independently.

In the construction of FIG. 6C, the first pump 1 and the second pump 2 function independently of each other. To be specific, the first and second suction inlets 150, 151 and the first discharge outlets 152, 153 of the first pump 1 and the second pump 2 are connected through the respective sockets 260 independently to separate connection tubes 172, 173, 178, and 179.

In this embodiment, one of the two pumps may be used as a vacuum pump and the other pump as a compressor, for example.

Now, the constructions of the socket 260 and an orifice which is preferably adapted for the suction inlets and the discharge outlets 150 through 153 and the manner for one-touch coupling of the orifice and the socket will be described below with reference to FIGS. 7A through 7D. It is easily understood that the suction inlets and the discharge outlets 150 through 153 may be perfectly identical in structure.

Figure 7A:
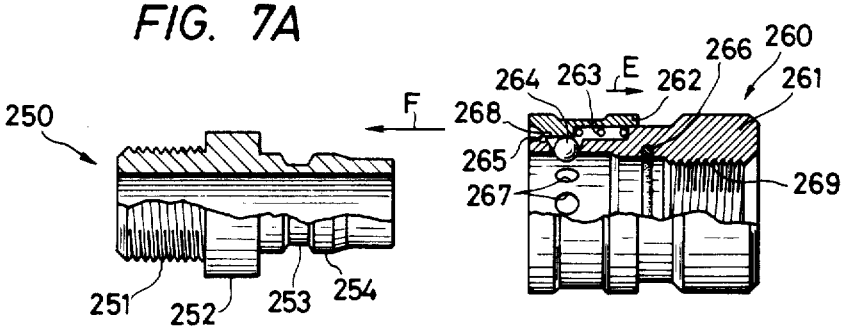
FIGS. 7A to 7D are partially cutaway side views of suction inlet/discharge outlet and a socket for illustrating the structures of the suction inlet/discharge outlet and the socket and the manner of their connection.

In the construction of FIG. 7A, the orifice 250 is tubular in shape. On one end of the orifice 250, a male screw 251 is formed for engagement with a female screw thread formed on the casing (central barrel 125) of the pump. On the other end of the orifice 250 (right end in the diagram), an insertion end or male fitting 254 is formed for insertion into the socket 260.

A flange 252 is formed as interposed between the male screw 251 and the insertion end 254. A groove 253 is formed between the insertion end 254 and the flange 252.

The socket 260 is composed of a socket body 261, a sleeve 262, a compression coil spring 263, balls 264, a stop ring 265, and an O-ring 266.

The socket body 261 is tubular in shape. In the inner surface at one end of the socket body 261, a female screw thread 269 is formed for screw engagement with a male screw to be formed on a connection tube, a discharge tube, a suction tube, etc. On the other side (left-hand end) of the socket body 261, one or more holes 267 for balls are formed. An annular groove is formed on the inner surface of the socket body 261 between the ball hole 267 and the female screw thread 269 and the O-ring 266 is set in the groove.

The sleeve 262 is tubular in shape. It is set as wrapped around the periphery of the portion of the socket body 261 in which the ball hole 267 is formed, so that it is slidable in the axial direction of the socket 260. On the inner surface of the sleeve 262, a raised strip or ridge 268 is formed as extended in the circumferential direction.

Between the ridge 268 of the sleeve 262 and the socket body 261, there is disposed a compression coil spring 263 which is adapted to bias the sleeve 262 in the direction opposite the direction of the arrow E. Since the left-hand lateral side of the ridge 268 contacts the stop ring 265 fastened to the periphery of the edge part of the socket body 261 outer than the ball holes 267, the sleeve 262 is never allowed to separate from the socket body 261.

When the sleeve 262 is located at the position indicated in FIG. 7A, the balls 264 are supported in place by the ball holes 267 and the apex plane of the ridge 268. In this case, a part of each ball 264 protrudes into the socket body 261 because each ball 264 is held in contact with the ridge 268 of the sleeve 262. Since the outside diameter of each ball 264 is greater than the diameter of the ball hole 267, each ball 264 is never allowed to slip out of the ball hole 267 into the inner side of the sleeve 262. The diameter of a circle defined by the leading ends of the balls 264 which protrudes toward the axis of the socket body 261 is smaller than the outside diameter of the insertion end 254 of the orifice 250 and is equal to or larger than the outside diameter of the groove 253.

Now, the manner of connection between the orifice 250 and the socket 260 will be described below.

First, in the construotion of FIG. 7A, the sleeve 262 of the socket 260 is slid in the direction of the arrow E with the force enough to overcome the repulsive force of the compression coil 263. This slide breaks the engagement between the ridge 268 and the balls 264 and enables the balls 264 to move away from the axis of the socket body 261.

Figure 7B:
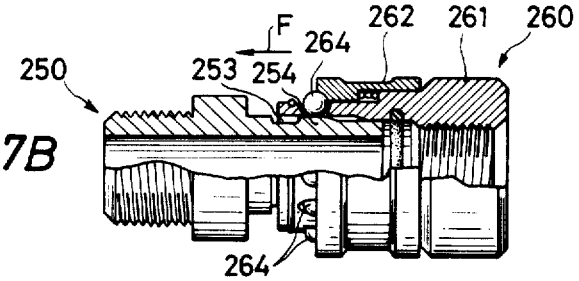
Figure 7C:
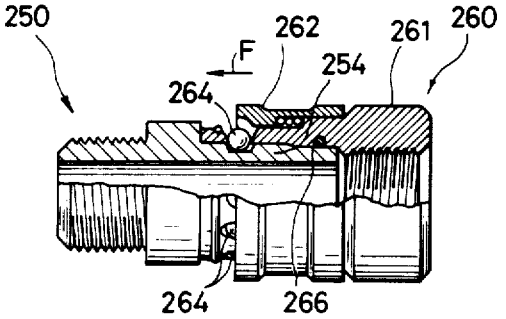

In the ensuing state, the socket 260 is moved in the direction of the arrow F and set into the insertion end 254 as illustrated in FIG. 7B. As is noted from this diagram, the balls 264, owing to the contact with the insertion end 254, are moved temporarily in the outward direction away from the axis of the socket 260. Thereafter, in consequence of the movement of the socket 260 in the direction of the arrow F, the balls 264 are moved in the same direction along the surface of the insertion end 254.

As the socket 260 is further moved in the direction of the arrow F, the peripheral surface of the insertion end 254 comes into intimate contact with the O-ring 266 disposed on the inner surface of the socket 260 to establish airtightness between the orifice 250 and the socket 260. Thereafter, the ball 264 reaches the groove 253, at which time the balls positioned above the groove 253 are caused to fall into the groove 253.

Figure 7D:
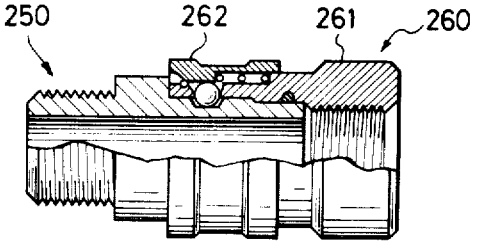

In the ensuing state, when the force applied so far upon the sleeve 262 is released, the sleeve 262 is returned in the direction of the arrow F and the balls opposed to the lower part of the groove 253 are pushed up into the groove 253 by the ridge 268 of the sleeve 262 and, at the same time, all the balls are supported by the apex plane of the ridge 268 so as not to separate from the groove 253. This state is depicted in FIG. 7D.

As noted from the description given so far, in the present invention, the connection between the orifice 250 which can be the suction inlet or the discharge outlet on one part and the socket 260 on the other part is obtained very simply in a manner enough to establish ample airtightness. The separation of the orifice from its respective socket can be effected very easily by reversing the procedures described above.

Optionally, the socket 260 may be used for the suction inlet 150, 151 or the discharge outlet 152, 153 and the orifice for the socket of the connection tube.

By suitably selecting a particular manner of connection from the manner of connection of the passages of tubes indicated in FIGS. 6A to 6C, the connection of the passages, the variation in the connection, or the disconnection of the passages can be attained with great ease.

As noted from the foregoing description, the embodiment of FIG. 1 is for connection of two pumps in such a manner that the axes of the pistons of the first and second pumps will agree with each other and the pistons will be disposed in one and the same direction.

This invention has no reason to be limited only to the embodiments cited above. For example, the two pumps may be disposed as that the axes of their respective pistons will coincide and the pistons will be symmetrically disposed as laid in opposite directions. In this case, the stationary electromagnets of the pumps are desired to be excited in the same phase.

Figure 9:
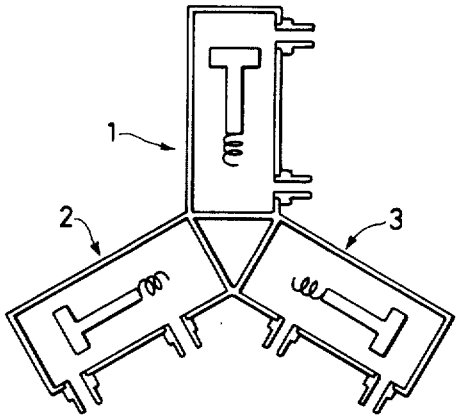
Figure 10:
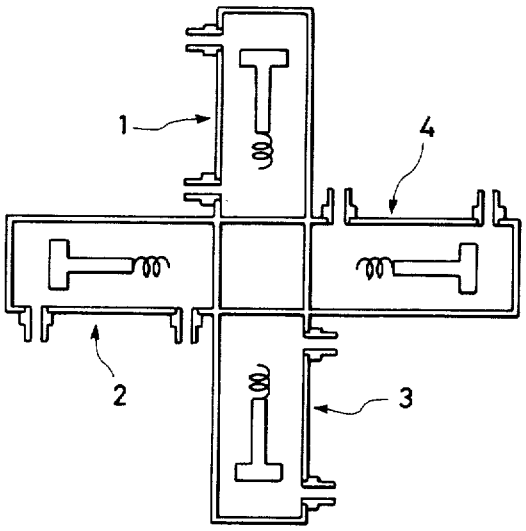

Optionally, three (denoted by the reference numbers 1~3) or four (denoted by the reference numbers 1~4) pumps may be symmetrically combined as illustrated in FIGS. 9 and 10. More pumps may be combined when necessary. The individual pumps may be symmetrically disposed not only two-dimensionally but also three-dimensionally.

As is clear from the foregoing description, this invention brings about the following effects:

(1) Since a plurality of pumps are integrally combined, the manner of serial/parallel connection of the suction inlets and the discharge outlets of the individual pumps can be freely selected. As the result, the amount of suction or discharge or the degree of vacuum or compression can be selected at a multiplicity of stages at a small sacrifice of the energy of the alternating current power source fed to the pumps. Moreover, the pumps are allowed to function, either simultaneously or independently, as a vacuum pump and as a compression pump.

(2) The vibrations of the plurality of pumps are allowed to be offset by causing the individual pumps to be disposed so that the axes of their respective pistons will intersect at one point and the pistons will assume the relation of rotational symmetry with respect to this point. The integrated electromagnetic reciprocating pump consequently obtained emits very lettle vibration and noise.

What is claimed is:

1. An electromagnetic reciprocating pump assembly having a pair of pumps integrally joined, said pumps each comprising:

a piston provided with a piston head and a magnetic armature, and having an axis of movement, a cylinder to accommodate said piston head and define a compression chamber in combination with said piston head, a suction hole and a discharge hole formed through the wall of said compression chamber, a suction valve and a discharge valve disposed respectively in said suction hole and discharge hole so as to open and close selective said suction hole and discharge hole in accordance with the reciprocation of said piston in the axial direction and thereby to transfer a fluid in a prescribed direction, a return spring to bias said piston in one direction, a stationary electromagnet to attract said magnetic armature in the opposite direction, a suction inlet communicating with said suction hole and serving to admit said fluid therethrough, and a discharge outlet communicating with said discharge hole and serving to discharge said fluid therethrough wherein axes of said pistons in the pair of pump forming the pump assembly are aligned on a common straight line, and each of their pistons is urged in the same direction by their respective return springs, and said stationary electromagnets of the pumps in said pair are alternately excited by the successive half waves of an alternating current, the pistons thereby being movable independently of each other and moving oppsitely from each other during operation so the vibrations of each of the pistons is offset by opposite direction movement of the other piston along the same axis.

* * * * *

UNITED STATES PATENT AND TRADEMARK OFFICE

CERTIFICATE OF CORRECTION

PATENT NO. : 4,718,832

DATED : January 12, 1988

INVENTOR(S) : Shiro Takahashi

It is certified that error appears in the above-identified patent and that said Letters Patent is hereby corrected as shown below:

Column 8, line 53, after "therethrough", insert a comma (—,—).

Column 8, line 54, delete first occurence of "pump" and insert —pumps—.

Column 8, line 61, delete "oppsitely" and insert—oppositely—.

Signed and Sealed this

Twenty-eighth Day of June, 1988

*Attest:*

DONALD J. QUIGG

*Attesting Officer*

*Commissioner of Patents and Trademarks*